US007947162B2

(12) United States Patent
Hautier et al.

(10) Patent No.: US 7,947,162 B2
(45) Date of Patent: May 24, 2011

(54) FREE STANDING SINGLE-CRYSTAL NANOWIRE GROWTH BY ELECTRO-CHEMICAL DEPOSITION

(75) Inventors: Geoffroy Hautier, Sint-Pieters-Woluwe (BE); Philippe M. Vereecken, Leuven (BE)

(73) Assignees: IMEC, Leuven (BE); Katholieke Universiteit Leuven (KUL), Leuven (BE)

( * ) Notice: Subject to any disclaimer, the term of this patent is extended or adjusted under 35 U.S.C. 154(b) by 898 days.

(21) Appl. No.: 11/746,023

(22) Filed: May 8, 2007

(65) Prior Publication Data

US 2008/0217181 A1 Sep. 11, 2008

Related U.S. Application Data

(60) Provisional application No. 60/799,057, filed on May 9, 2006.

(51) Int. Cl.
*C25D 5/02* (2006.01)

(52) U.S. Cl. ..... 205/118

(58) Field of Classification Search ..... 205/96, 205/118, 220

See application file for complete search history.

(56) References Cited

U.S. PATENT DOCUMENTS 2,905,601 A * 9/1959 Duva et al. ..... 205/247
4,709,122 A * 11/1987 Samuels ..... 174/50.5
6,187,165 B1 * 2/2001 Chien et al. ..... 205/118
6,890,413 B2 * 5/2005 Cheng et al. ..... 205/96
2003/0217928 A1 * 11/2003 Lin et al. ..... 205/109
2006/0038990 A1 * 2/2006 Habib et al. ..... 356/301
2006/0270229 A1 * 11/2006 Corderman et al. ..... 438/689

OTHER PUBLICATIONS

Prieto et al. ("Electrodeposition of Ordered Bi2Te3 Nanowire Arrays," J. Am. Chem. Soc., 2001, 123 (29), pp. 7160-7161).*

Li et al. ("A route to fabricate single crystalline bismuth nanowire arrays with different diameters," Chemical Physics Letters vol. 378, Issues 3-4, Sep. 5, 2003, pp. 244-249).*

Molares, et al. Single-Crystalline Copper Nanowires Produced by Electrochemical Deposition in Polymeric Ion Track Membranes. Advanced Materials 2001, 13, No. 1, January 5. pp. 62-65.

* cited by examiner

*Primary Examiner* — Luan V Van

(74) *Attorney, Agent, or Firm* — Knobbe Martens Olson & Bear LLP

(57) ABSTRACT

The present invention relates to a method for obtaining monocrystalline or single crystal nanowires. Said nanowires are grown in a pattern making use of electro-chemical deposition techniques. Most preferred, the electrolytic bath is based on chlorides and has an acidic pH. Single element as well as combinations of two elements nanowires can be grown. Depending on the element properties the obtained nanowire can have metallic (conductive) or semi-metallic (semi-conductive) properties. The observed nanowire growth presents an unusual behavior compared to the classical nanowire template-assisted growth where a cap is formed as soon as the metal grows out of the pattern. Under given conditions of bath composition and potential (current) settings the nanowires grow out of the pattern up to a few microns without any significant lateral overgrowth.

34 Claims, 11 Drawing Sheets

FREE STANDING SINGLE-CRYSTAL NANOWIRE GROWTH BY ELECTRO-CHEMICAL DEPOSITION

CROSS-REFERENCE TO RELATED APPLICATION

This application claims the benefit under 35 U.S.C. §119 (e) of U.S. provisional application Ser. No. 60/799,057, filed May 9, 2006, the disclosure of which is hereby expressly incorporated by reference in its entirety and is hereby expressly made a portion of this application.

FIELD OF THE INVENTION

The present disclosure is related to the field of nanowire growth. More specifically, the invention is related to the field of monocrystalline (or single crystal) nanowires. More specifically it is related to a method for creating single crystal nanowire structures using electro-chemical deposition without supporting template. It further contributes to the exploration of the field of nanowires for use in semiconductor devices. It also contributes to the development of lithographic patterns for NW growth.

BACKGROUND OF THE INVENTION

In the last years, a lot of effort has been put in the synthesis of one-dimensional nanostructures such as nanowires. Due to their restricted size, these structures exhibit novel physical and chemical properties, and have opened up a large new field of basic research as well as possible applications. Electro-chemical deposition (ECD) is becoming an increasingly attractive method for the synthesis of new materials and nanostructures. ECD has been shown very suitable for the fabrication of metal, alloy and compound nanowires in high-aspect ratio nano-structured porous templates (for instance anodized alumina). Single crystals were grown in template pores of micrometer length at room temperature by using commercial baths and reverse pulse plating in ultrasonic fields.

In Adv. Mater. 2001, 13(1), 62-65 Molares et al. report the fabrication of cylindrical poly- and single-crystalline copper wires, by means of the template method, with diameters between 60 and 500 nm and aspect ratios (length to diameter) up to 500 nm.

However, all the template-assisted or through-hole electrodepositions methods mentioned in the prior art still suffer from the fact that a "cap" is typically formed on top of the template or mask as soon as the nanowires or studs grow out of the pores or holes.

SUMMARY OF THE INVENTION

A method is disclosed for the fabrication or growth of monocrystalline nanowires (NW) starting from a pattern in a substrate. Said monocrystalline (also referred to as single crystal) NW are preferably metallic NW, semi-conductive or semi-metallic NW. The metal, semi-conductive or semi-metal is preferably selected from the group of In, Sb, Bi, Pb, Sn, As P and/or Te but the method of the preferred embodiments can be applicable to all metals that have the tendency to form large grained or monocrystalline deposits using electro-chemical deposition techniques. Said monocrystalline metallic, semi-conductive and/or semi-metallic NW have a preferred diameter of 10 nm up to 300 nm and more preferred said NW have a diameter of 40 nm up to 150 nm.

Using the method of the preferred embodiments, one-dimensional monocrystalline nanowires are grown vertically out of a pattern without significant lateral overgrowth onto the horizontal parts of the pattern thus keeping their high aspect ratio intact. Said vertical growth process is also referred to as tip growth. Tip-growth is obtained by tuning the distance or pitch between holes in a pattern (e.g. an array of holes), when the neighboring holes are close enough the flux of ions will be cut-off (pinched-off) in-between two neighboring nanowires, thus enhancing tip growth. A diffusion field needs to be created around the nanowire during the growth process such that no significant flux of metal ions remains towards the side walls of the nanowire and only tip growth is obtained, resulting in a one-dimensional nanowire growth.

The monocrystalline nanowires (NW) of the preferred embodiments can be single metal (semi-metal) NW, said metal (semi-metal) selected from the group of In, Sb, Bi, Pb, Sn, As P and/or Te. Alternatively the monocrystalline nanowires (NW) of the preferred embodiments can be a combination of two metals (semi-metals) selected from the group of In, Sb, Bi, Pb, Sn, As, P and/or Te.

The method for growing said monocrystalline NW is based on electro-chemical deposition (ECD), also referred to as plating (ECP), in an electrolytic bath. In a preferred mode, the electro-chemical deposition to grow monocrystalline NW is taking place at a constant potential. Alternatively and also preferred, the electro-chemical deposition to grow monocrystalline NW is taking place at a constant current.

The method of the preferred embodiments for growing monocrystalline nanowires (NW) using electro-chemical deposition in an electrolytic bath preferably starts with the step of first providing a substrate and deposit at least one layer onto said substrate and subsequently creating a dense pattern of holes into said at least one layer by means of a combination of lithographic patterning and etching. In a next step, the substrate is transferred into an electrolytic plating bath comprising at least one metal salt and performing electro-chemical deposition (ECD) to form the monocrystalline NW.

Preferably the at least one layer is a dielectric (or insulating) layer. The dielectric layer is preferably selected from the group of $SiO_2$, low-k dielectric materials (such as SiCO(H) materials, (Fluorinated) polyimides, benzocyclobutenes, Fluorosilicate glass, or the like) zeolites, or the like.

Alternatively and also preferred, before the step of depositing the dielectric layer an extra layer is deposited acting as barrier layer. The extra layer is preferably selected from the group of SiC, SiON, SiN, TaN, TiN, Ta, TaSiN, TiSiN, TiW and/or WN layer(s). These barrier layers are commonly used and available in semiconductor processing and are also referred to as (metal) hardmask layers.

Also alternatively and also preferred, before the step of depositing the dielectric layer and the extra layer a conductive layer (e.g. a tungsten comprising layer) is deposited onto the substrate.

The dense pattern in the dielectric layer comprises holes with a dense array, said dense array being defined as having a pitch (distance between two holes divided by the diameter of the holes) in the range of 1 to 5 such that the flux of ions from solution is minimized at the sidewalls of the NW and maximized at the top of the NW thereby promoting 1 dimensional vertical growth of the NW and preventing lateral growth. In other words the dense array is being defined such that the diffusion fields are pinched off.

The electro-chemical plating makes use of an electrolytic bath or plating bath. Preferably said electrolytic bath is acidic, to adjust the pH of the bath an acid can be added, said acid can be an inorganic acid, a preferred example of said acid is HCl (Chloride is also beneficial for the reaction). Alternatively the acid can be an organic acid such as Tartaric acid, citric acid, or the like. Preferably the pH of the bath is in the range of 1 up to 3.5, the most preferred pH is further dependent on the desired composition of the NW. The metal (or semi-metal) of interest should be present in the bath in the form of a salt, preferably said salt is a metal (or semi-metal) halogenide or sulfate and preferred example of said salt is a metal (or semi-metal) chloride such as $InCl_3$.

The method of the preferred embodiments preferably starts with the step of providing a substrate (e.g. a wafer) and depositing at least one layer onto said substrate. Said at least one layer preferably comprises a dielectric layer having a thickness of 100 nm up to 1 μm, said dielectric layer is preferably selected from the group of $SiO_2$, porous CVD low-k material such as for example (hydrogenated) silicon-oxy-carbide materials (SiCO(H)) and commercially available as ®Black Diamond and ®Aurora, organic (spin-on) low-k materials such as polyimides and benzocyclobutenes (commercially available as ®Silk), FluoroSilicateGlass (FSG), zeolites . . . .

Optionally and also preferred, an extra layer selected from the group of SiC, SiON, SiN, or the like can be deposited before the deposition of the dielectric layer.

Optionally and also preferred a conductive layer e.g. a tungsten comprising layer can be deposited onto said (wafer) substrate before depositing said extra layer and before depositing said dielectric layer, said tungsten (W) layer can be deposited by e.g. chemical vapor deposition (CVD) techniques.

Subsequently a dense pattern of holes will be created into said dielectric layer (optionally in the barrier layer as well) by means of a combination of lithographic patterning (photolithography and/or e-beam lithography) and ion etching (such as reactive ion etching or RIE) and etching. The substrate comprising the pattern will then be transferred into an electrolytic plating bath in which electro-chemical deposition (ECD) using an electrolytic bath is performed.

The electrolytic plating bath composition preferably comprises at least following compounds:

Metal (M) salt

Optionally acid or base to adjust the pH

Optionally an inert salt (AX) to adjust the electrolyte concentration

The metal (M) stands for a metal (or semi-metal) of the NW selected and is preferably selected from the group of In, Sb, Bi, Pb, Sn, or the like. In case indium (In) is the selected metal, the metal salt can be selected from the group of $InCl_3$, $In_2(SO_4)_3$.

The acid used to adjust the pH can be selected from the group of inorganic acids such as HCl, $H_2SO_4$, or the like or alternatively from the group of organic acids such as citric acid, tartaric acid. A preferred example of an organic base is sodium citrate. If needed an inert salt (AX) can be added wherein A stands for K, Li, Na, $NH_4$ or any other suitable cation such as an organic cation and X corresponds to a suitable anion such as Cl. A preferred example of an inert salt is KCl.

In a preferred embodiment, the dense pattern of holes preferably comprises holes with in plane dimensions in the range of 100 nm up to 1 μm deep and a diameter opening in the range of 10 nm up to 300 nm, more preferred the diameter of said holes is in the range of 40 nm up to 150 nm. Said holes are also referred to in semiconductor industry as contact holes. In a preferred embodiment said pattern comprises holes with a dense array, said dense array being defined as having a pitch (distance between two holes divided by the diameter of the holes) in the range of 1 to 4.

In an alternative embodiment so-called "thiefs" structures are surrounding the NW hole. A thief is a dummy or in other words sacrificial structure with the purpose of consuming or thieving current and thus metal ions away from the actual NW hole. The thief structure can be a sacrificial structure that can be removed afterwards or can be a permanent structure that will not be removed afterwards.

BRIEF DESCRIPTION OF THE DRAWINGS

All figures/drawings are intended to illustrate some aspects and embodiments of the present invention. The Figures are depicted in a simplified way for reason of clarity. Not all alternatives and options are shown and therefore the invention is not limited to the content of the given drawings. Like numerals are employed to reference like parts in the different figures.

FIG. 7A represents a dense array and FIG. 7B represents an isolated array. The simulation clearly shows the material flux directed to the lateral facets represented by the vectors is definitely weaker for the nanowire surrounded by dense neighbors than for the isolated nanowire.

DETAILED DESCRIPTION OF THE PREFERRED EMBODIMENT

Figure 1:
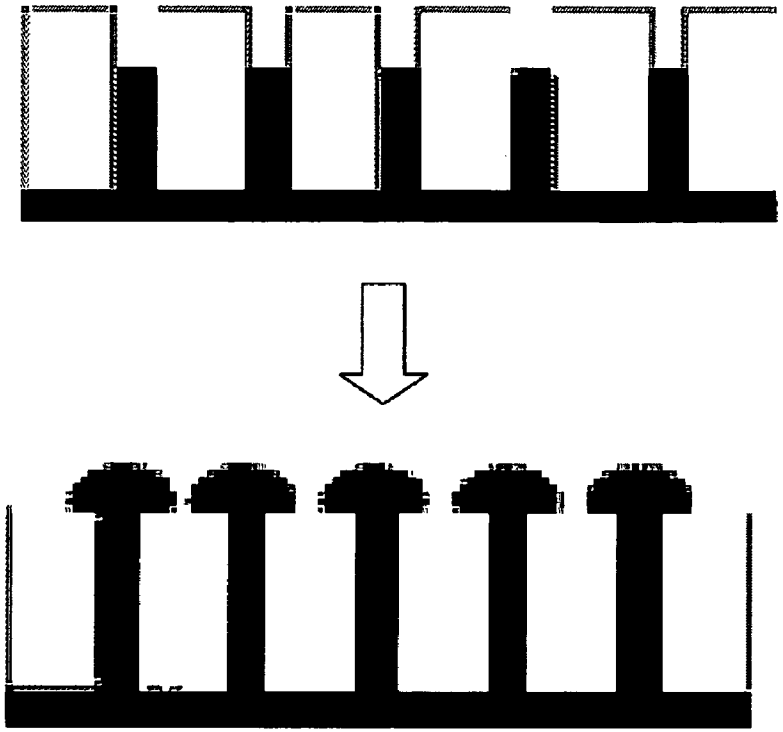
PRIOR ART FIGURE 1
FIG. 1 (PRIOR ART) illustrates the growing of nanowires using electro-chemical deposition in a template (also referred to as template-assisted growth) resulting in a cap as soon as the nanowire starts to grow out of the template.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof.

The term "monocrystalline" or "single crystal" refer to a crystalline solid in which the crystal lattice of the entire sample is continuous and unbroken to the edges of the sample, with no grain boundaries. The opposite of a single crystal is a polycrystalline sample, which is made up of a number of smaller crystals.

The term "Electrochemical Deposition" (ECD) also known as Plating as referred to in this application is the process used to deposit a metal or a combination of metals onto a substrate. The ECD process is the process of depositing metal(s) by means of electrolysis and involves placing a substrate (e.g. a wafer) as one electrode and at least one other electrode (counter electrode) in an aqueous electrolyte containing the metal ions and then passing an electric current through the system, which causes the metal(s) (after reduction) to adhere onto the substrate.

The term "pattern" or "mask" as referred to in this application is used to define structures in a layer deposited onto a substrate e.g. a wafer substrate. The patterns are formed on said wafer substrates using patterning tools known as a combination of lithography (photolithography and e-beam lithography) and etching (such as reactive ion etching or RIE). The term "pattern" or "mask" as used in this application may not be confused and is different from the term "template" and said difference is mainly related to its vertical dimensions (depth). The term "template" or "template assisted growth of nanowires" refers to much deeper openings in a material such that the deposition and/or formation of nanowires is taking place completely inside these openings. The "pattern" or "mask" as used in this application is only used as a starting point for the growth of nanowires.

The term using "pattern" or "mask" as "starting point" for growth of nanowires as referred to in this application means that significant growth of the nanowires is taking place outside the "pattern" or "mask" such that the length of the resulting nanowires is longer than the depth of the holes in the "pattern" or "mask". Nevertheless, the method of the preferred embodiments is also applicable using a template or a "template assisted growth of nanowires".

The preferred embodiments provide a method for the growth of single crystal or monocrystalline nanowires (NW) using electro-chemical deposition. More specifically a method is disclosed to produce monocrystalline NW. Said method preferably starts using a pattern or mask into a substrate, alternatively a porous material or etched holes (contact holes or vias) can be used as starting point to grow said single crystal NW.

In a preferred embodiment, said pattern or mask is preferably a pattern in a substrate with preferred dimensions in the range of 100 nm up to 1 μm deep and 10 nm to 300 nm in diameter, more preferred said pattern has dimensions of 300 nm deep and a diameter of 40 nm up to 150 nm. Said substrate can be e.g. a silicon wafer, said pattern can be e.g. contact holes being patterned in a dielectric layer deposited onto said wafer substrate.

Figure 8:
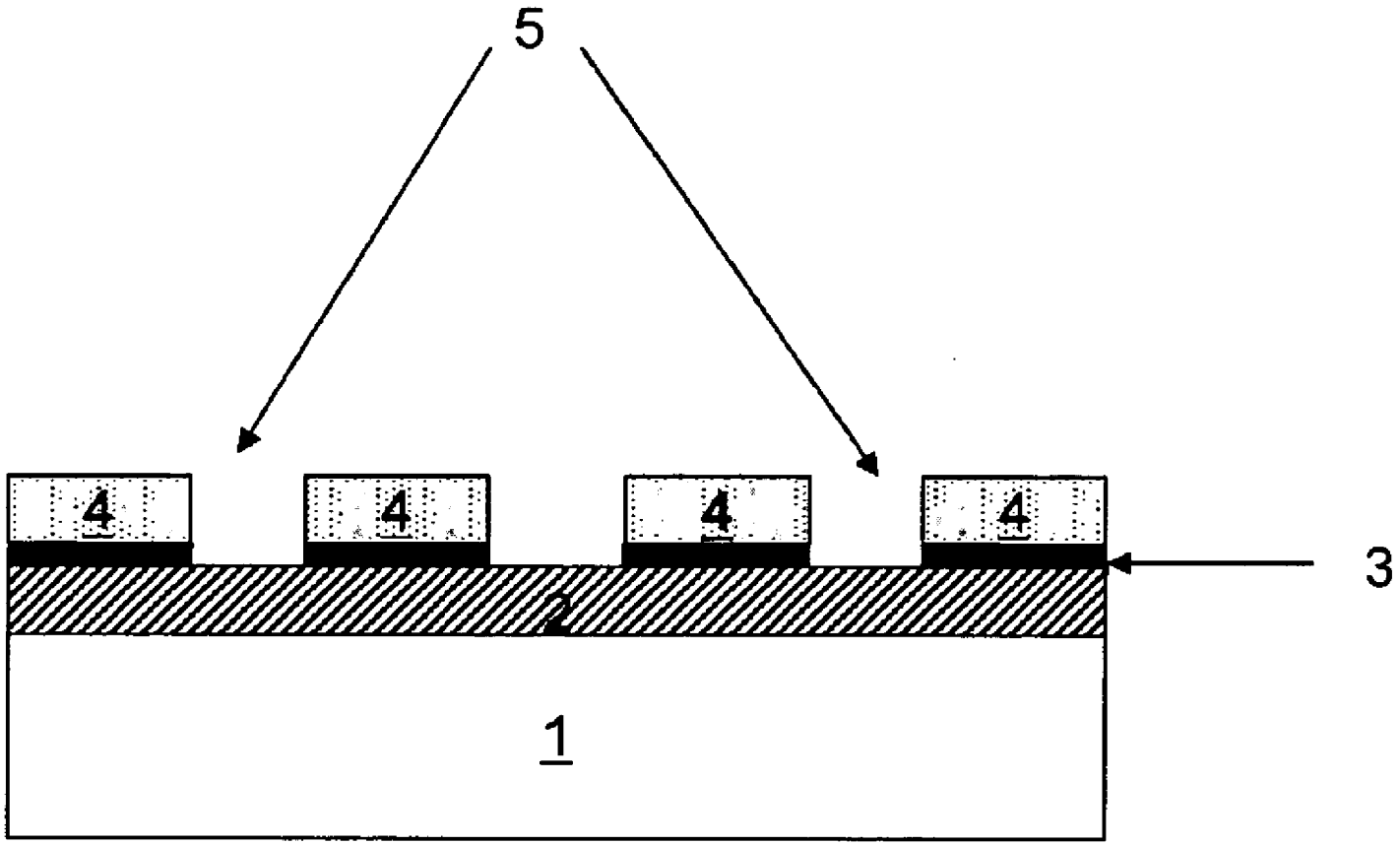
FIG. 8 illustrates a cross-section of a substrate having a suitable pattern according to the method of the preferred embodiments.
Figure 11:
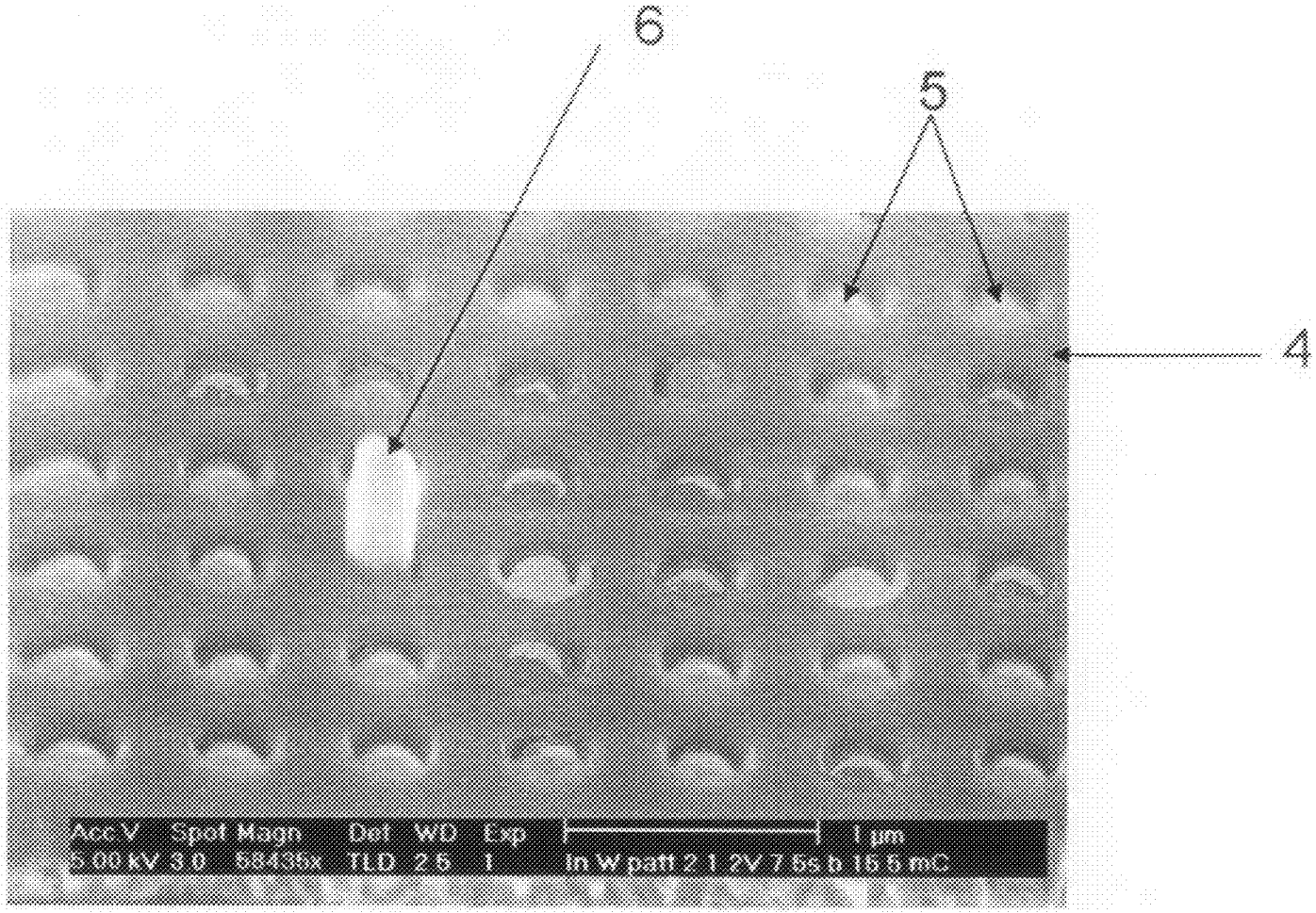
FIG. 11 shows a 45° tilted SEM view for a 300 nm diameter dense array after 7.5 s plating at −1.2V vs. Ag/AgCl. It clearly shows that indium nanowires grow much faster as soon as it is popping out of the holes.

Preferably said pattern is used as a starting point for electro-chemical deposition of the nanowires. FIG. 11 illustrates the pattern 5 having In—NW 6 inside the holes of the pattern 5. FIG. 8 illustrates a cross section of the substrate 1 having a suitable pattern 5. Said pattern 5 is preferably fabricated using a silicon wafer 1 as starting point. Optionally a conductive layer 2 e.g. a tungsten comprising layer can be deposited onto said wafer substrate, said tungsten (W) layer can be deposited by e.g. chemical vapor deposition (CVD) techniques. Subsequently and also optionally a barrier layer 3 is deposited; the extra barrier layer is preferably selected from the group of SiC, SiON, SiN, TaN, or the like, and has a preferred thickness of around e.g. 30 nm. Subsequently a dielectric layer 4 is deposited, said dielectric (or insulating) layer has preferably a thickness of 50 nm up to 1 μm (e.g. 300 nm) and is preferably selected from the group of $SiO_2$, low-k dielectric materials (such as SiCO(H) materials, (Fluorinated) polyimides, benzocyclobutenes, Fluorosilicate glass, and the like) zeolites, polymers, resist layers, alumina, and the like. Using optical lithography and standard Reactive Ion Etch (RIE) techniques contact holes are defined and patterned into said dielectric layer 4 and optionally in the barrier layer 3, if an extra conductive layer 2 (e.g. tungsten layer) is deposited said tungsten layer will be kept intact. If needed a cleaning step can be added to improve adhesion during subsequent electrochemical deposition of nanowires. If a tungsten layer exist, said cleaning step can comprise a short dip (e.g. 1 minute) of the substrate comprising the pattern into a solution comprising $NH_4OH$ (approx. 3%) which will remove possible tungsten-oxide from the substrate. If no extra conductive layer is deposited, said cleaning step can comprise a short dip in a diluted HF solution to remove oxides at the bottom of the contact holes.

The formation of monocrystalline nanowires is disclosed, said formation is based on the potentiostatic electro-deposition from an electrolyte solution. Using the method of the preferred embodiments, said one-dimensional monocrystalline nanowires grow vertically out of the pattern without significant lateral overgrowth onto the horizontal parts of the pattern thus keeping their high aspect ratio intact The method of the preferred embodiments can be applied to grow monocrystalline NW comprising In, Sb, Bi, Pb, Sn, As, P or Te. The grown NW can be single element NW (e.g. In—NW, Sb—NW, and the like) or can be a combination of above mentioned elements (e.g. InSb—NW, BiSb—NW, InAs—NW, InAs—NW, InP—NW, and the like). Depending on the element properties said monocrystalline NW can have metallic (or conductive) or semi-conducting properties.

According to a preferred embodiment the method for growing monocrystalline NW is based on electro-chemical plating which makes use of an electrolytic bath or plating bath. Said electrolytic bath preferably comprises halogens. Most preferred said halogen is Cl, alternatively said halogen is I or Br. Alternatively Said electrolytic bath comprises sulfates. Preferably said electrolytic bath is acidic; to adjust the pH of the bath an acid can be added. A preferred example of said acid is HCl; alternatively and also preferred said acid is an organic acid such as tartaric-acid, citric-acid, and the like. Preferably the pH of the bath is in the range of 1 up to 3.5, the most preferred pH is further dependent on the desired composition of the NW.

The growth of monocrystalline In—NW shall take place at preferred pH values of 2.5±0.2, while preferred pH values for the growth of Bi—NW are much lower and around pH≈1. The metal (or semi-metal) of interest should be present in the bath in the form of a salt, preferably said salt is a metal (or semi-metal) halogenide or sulfate, preferred examples are e.g. a metal (or semi-metal) chloride or a metal (or semi-metal) sulfate. As an example, if indium monocrystalline NW need to be fabricated, the electrolytic bath comprises $InCl_3$. If antimony monocrystalline NW need to be fabricated, the electrolytic bath comprises $SbCl_3$ and if bismuth monocrystalline NW need to be fabricated, the electrolytic bath comprises $BiCl_3$. If needed extra salt can be added to the bath, preferred examples of said salt are chlorides such as KCl, citrates such as $Na_3$-citrate, tartrates such as $Na_3$-tartrate, and the like. The concentration of the extra salt is preferably in the range of 0M up to 6M. The time of the electro-chemical deposition process is dependent on the desired length of the NW; a minimum time of 5 seconds is preferably needed. The maximum time can be up to several tens of seconds.

In a preferred embodiment, the electro-chemical deposition to grow monocrystalline NW is taking place at a constant potential. In a preferred mode, this deposition occurs at negative cell potential (two-electrode configuration) or alternative and also preferred at an electrode potential negative to the equilibrium potential (open-circuit potential) in the case a reference electrode is used (3-electrode configuration). The optimal potential is dependent on the desired composition of the NW, also higher deposition rates are obtained at more negative potentials. The optimal potential is chosen such that elongated NW structures are obtained. Too positive deposition potentials may result in non-uniformity and poor adhesion, too negative potentials may lead to recrystallization and the formation of a cap and subsequently a polycrystalline film. To grow indium monocrystalline NW, the optimal potential should be in the range of −1.3V (versus Ag/AgCl/3M NaCl reference electrode) up to −0.8V (vs. Ag/AgCl), the preferred potential is −1.2V.

In an alternative and also preferred embodiment, the electro-chemical deposition to grow monocrystalline NW is taking place at a constant current. The optimal current is dependent on the desired composition of the NW and on the molar concentration of the metal ions species in the electrolyte bath. A more concentrated metal ion bath composition will need more negative current values. To grow monocrystalline indium nanowires the optimal current setting is about −15 $mA/cm^2$ for a 0.05M $InCl_3$ bath, the optimal current setting is about 0.3 $mA/cm^2$ for a 0.001M $InCl_3$ bath.

Figure 5B:
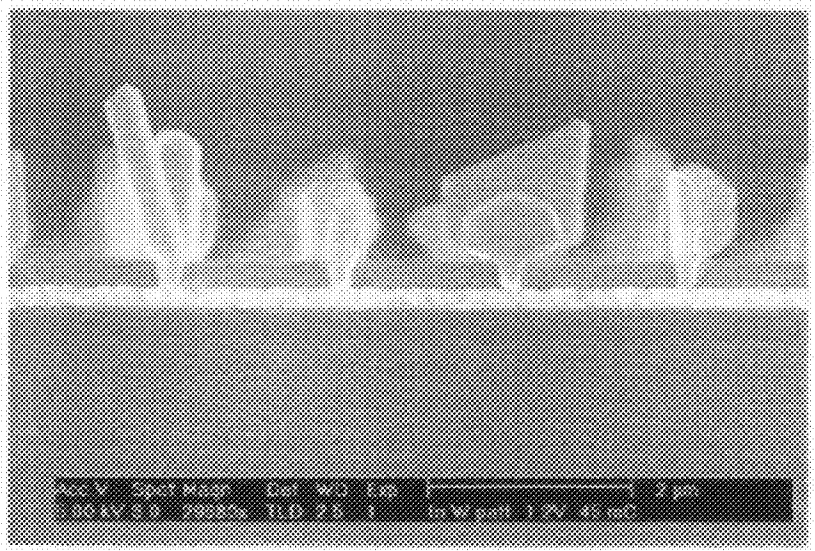
FIGS. 5A and 5B illustrate the effect of the pitch (or distance between two neighboring contact holes divided by the diameter of the contact holes). Two regions with the same diameter contact holes (300 nm) but with different pitch (dense in 5A and isolated in 5B) are compared with each other through SEM cross-sections after plating at −1.2V versus Ag/AgCl. It can be seen that the peculiar behavior of monocrystalline axial growth without significant lateral growth after popping out of the pattern is only observed for the dense pitch. The isolated pitch shows faceted single-crystal but with lateral overgrowth.
Figure 5A:
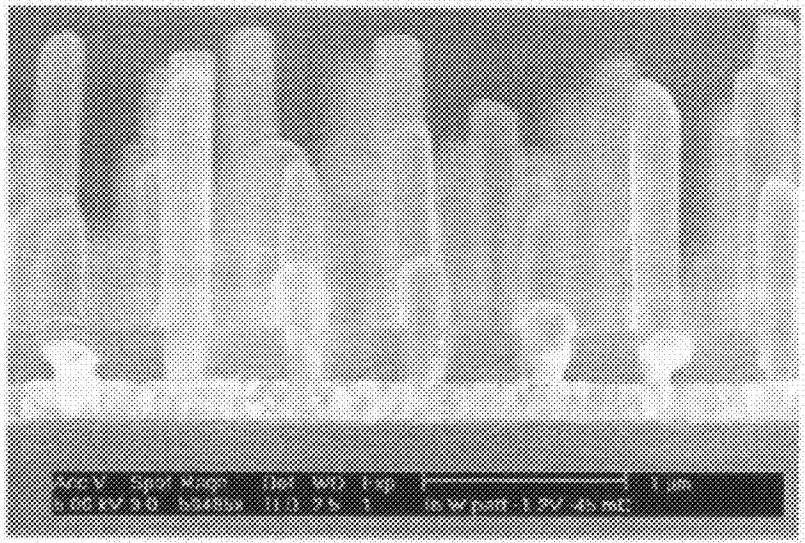
Figure 7B:
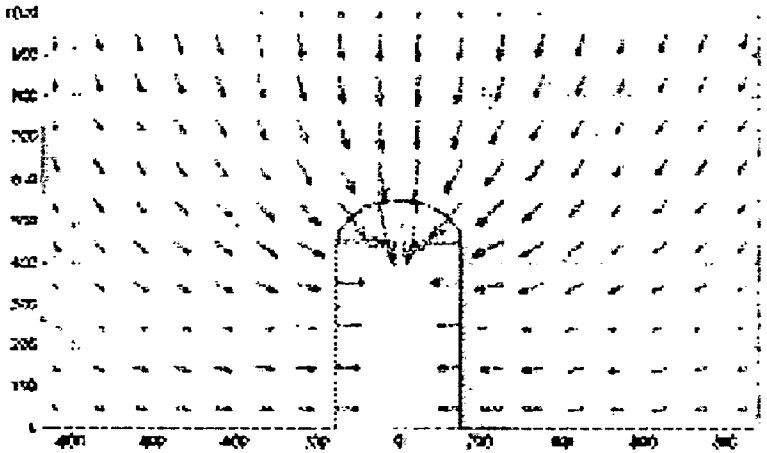
FIGS. 7A and 7B represent material flux computed after resolution of 2D steady state diffusion equation by finiteelement method.
Figure 7A:
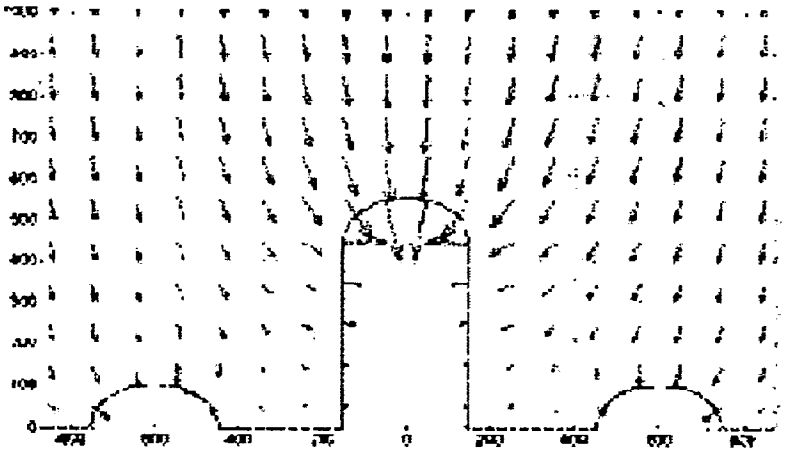

Another important parameter in the method of the preferred embodiments is the design of the lithographically defined pattern since it will determine the one-dimensional nature of the obtained wires. The one-dimensional structure is obtained through control of the diffusion field of metal ions close to the holes and wires. The diffusion fields have to be such that the flux of ions is directed towards the tip of the growing nanowires and negligible at the side of the wires. (FIGS. 7A and 7B). In one embodiment conditions of preferential tip-growth can be obtained by tuning the distance or pitch between the holes in an array of holes. When the neighboring holes are close enough the flux of ions will be cut-off in-between two neighboring nanowires, thus enhancing tip growth. The distance between the (contact) holes in the pattern is also referred to as pitch. The pitch is defined as the distance between individual (contact) holes divided by the diameter of the (contact) hole. A large pitch will lead to lateral overgrowth and needs to be avoided (see FIG. 5B); a more isolated pitch will lead to one-dimensional monocrystalline NW (see FIG. 5A). FIGS. 5A and 5B illustrate the effect of the pitch during electro-chemical growth of indium NW in a pattern. Two regions with the same diameter contact holes (300 nm) but with different pitch (dense and isolated) are compared with each other through SEM cross-sections after plating at −1.2V versus Ag/AgCl using a $InCl_3$ comprising bath. It can be seen that the peculiar behavior of monocrystalline axial growth without significant lateral growth after popping out of the pattern is only observed for the dense pitch (pitch=1) as shown in FIG. 5A. The isolated pitch (pitch=8) as shown in FIG. 5B shows faceted single-crystal but with lateral overgrowth after popping out of the pattern. The optimal pitch depends on the metal ion concentration in the electrolyte bath; larger pitches can be used when using lower metal ions concentrations. In the case of 0.05M $InCl_3$ bath, a pitch of 2 to 4 is needed to grow one-dimensional indium nanowires.

Figure 9A:
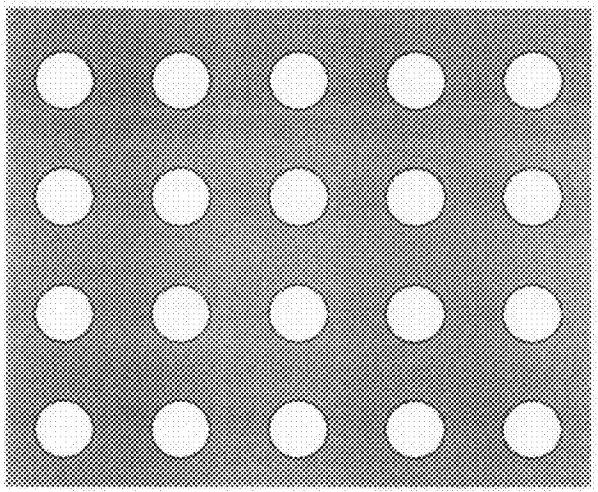
FIG. 9A illustrates an array of holes with pitch equal to 2.
Figure 9B:
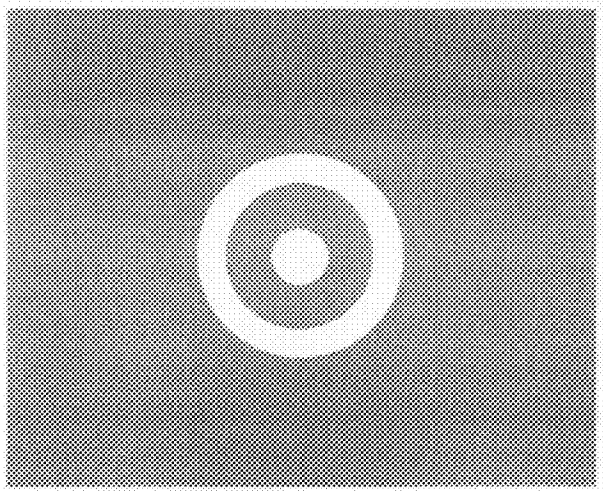
FIG. 9B illustrates an example of a possible thief structure comprising a central hole surrounded by a circular thief structure. As an alternative thief structure
Figure 9C:
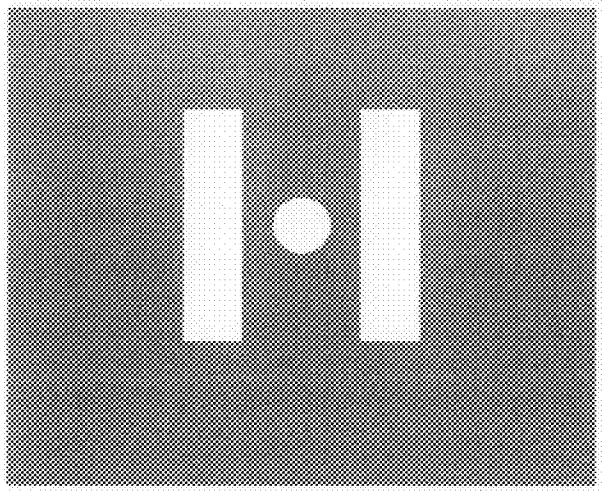
FIG. 9C shows a central hole surrounded by two rectangular thief structures.

In another embodiment preferential tip growth can be obtained through the introduction of so-called "thiefs" surrounding the hole. A thief is a dummy or in other words sacrificial structure with the purpose of consuming or thieving current and thus metal ions away from the actual NW. The thief structure can be a sacrificial structure that can be removed afterwards or can be a permanent structure that will not be removed afterwards. The thief will create a diffusion field around the nanowire such that no significant flux of metal ions remains towards the side walls of the nanowire and only tip growth is obtained, resulting in a one-dimensional nanowire. The resulting metal or metal compound deposited on the thief does not hold any function afterwards. In this configuration, isolated nanowires can be electrodeposited onto a part of the wafer die. An example of possible thief structures is shown in FIGS. 9B and 9C (together with the array concept, FIG. 9A). The thief can have a ring or segmented ring structure surrounding the hole where the nanowire will be grown. FIG. 9B illustrates an example of a possible thief structure comprising a central hole surrounded by a circular thief structure. As an alternative thief structure FIG. 9C shows a central hole surrounded by two rectangular thief structures. Many other shapes such as continuous and segmented squares, diamonds or lines can be designed. Alternatively also several holes can surround the NW hole(s) (such as in an array) where now the surrounding holes have no functional purpose other than thieving the current (the holes at the outer edges will have crystals with lateral overgrowth as shown in FIG. 5B).

Figure 10:
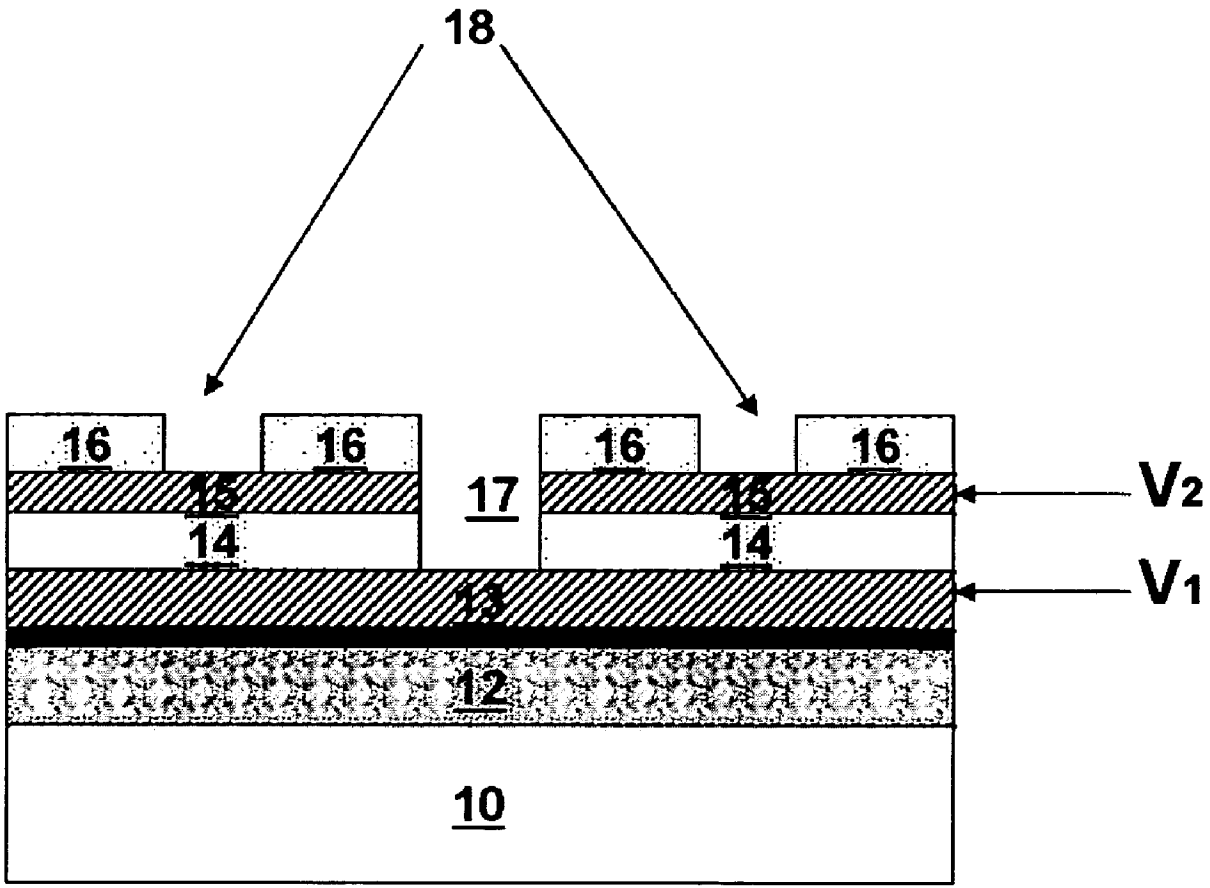
FIG. 10 shows a bipotentiostatic set up to create a thief structure surrounding the NW hole.

In an another alternative embodiment using "thief" structures surrounding the hole, the potential (or current) applied to the thief structure is different compared to the potential (or current) applied to the hole structure to grow the monocrystalline NW. To achieve said separate voltage (current) supply, bipotentiostatic plating can be used. The voltage applied to the thief structure is preferably at a predefined time to avoid lateral overgrowth. An example of a bipotentiostatic set up to create a thief structure surrounding the NW hole is shown in FIG. 10. A substrate is provided, said substrate can comprise a Si wafer 10 with optionally a dielectric layer (e.g. $SiO_2$) 12 and barrier layer (e.g. SiC layer) 13 deposited on top of Si wafer. A first conductive layer 13 (e.g. W layer) is deposited onto said substrate 10. A first dielectric layer 14, followed by a second conductive layer 15 (e.g. W layer) and a second dielectric layer 16 is deposited onto said first conductive layer 13. A NW hole 17 is patterned creating a hole in said second dielectric layer 16, second conductive layer 15 and first dielectric layer 14 stopping on said first conductive layer 13. A thief structure 18 (e.g. a ring) is patterned in said second dielectric layer 16 stopping on said second conductive layer 15. A first potential $V_1$ will be applied to said first conductive layer 13 to achieve the monocrystalline NW during the electrochemical deposition process. A second potential $V_2$ will be applied to said second conductive layer 15 to achieve the thief structure during the electrochemical deposition process.

The diameter of a monocrystalline NW as obtained with the method of the preferred embodiments is dependent on the diameter of the contact holes in the pattern. A smaller diameter will lead to monocrystalline NW with smaller diameter. A pattern can comprise lithographically defined single, multiple or arrays of holes with varying diameter etched into e.g. a dielectric layer. Said array with varying diameters will hence lead to the formation mono-crystalline NW with different diameter.

It has to be noted that, this method of the preferred embodiments as described above is different from the template-assisted growth of nanowires, where the pores defined or shape the nanowires. In this preferred embodiment, only a shallow pattern is necessary to initiate the growth, and the wires grow independently further without the assistance of a template to support the wires. However, because of the nature of this technique, also templates can be used to initiate the growth. Growth can be stopped before the wires leave the template or grown out of the template without forming the typical cap as shown in FIG. 1. In both cases, also single crystal; or monocrystalline wires will be obtained.

EXAMPLES

Example 1

Single-Crystal Indium (In) Nanowire Growth by Electro-Chemical Deposition in a Pattern Indium monocrystalline nanowires were electro-chemical deposited under potentiostatic conditions from an aqueous solution comprising 0.05M $InCl_3$, 0.2M KCl and 0.005M HCl (pH=2.7). A standard three-electrode cell with a Pt mesh counter electrode and Ag/AgCl/3M NaCl reference electrode (0.22V versus the "Standard Hydrogen Electrode") was used. The pattern for deposition consisted of lithographically defined arrays of holes with varying diameter etched into a 300 nm $SiO_2$/30 nm SiC bilayer on top of a tungsten film deposited onto an oxidized silicon wafer. Different arrays of patterned holes had diameters varying from 300 to 150 nm and a spacing to diameter ratio (pitch) of 2 (dense array) or 8 (isolated array). Before growth, the substrate was cleaned with $NH_4OH$ (2.9 wt. %) for 1 minute. This clean improves indium adhesion on tungsten by removing the tungsten oxide layer before deposition. The obtained indium nanowires were characterized with scanning electron microscopy (SEM) and electron back scattered diffraction (EBSD). EBSD is a technique which allows crystallographic information to be obtained from samples in the scanning electron microscope (SEM). In EBSD a stationary electron beam strikes a tilted crystalline sample and the diffracted electrons form a pattern on a fluorescent screen. This pattern is characteristic of the crystal structure and orientation of the sample region from which it was generated. The diffraction pattern can be used to measure the crystal orientation, measure grain boundary misorientations, discriminate between different materials, and provide information about local crystalline perfection.

Figure 3:
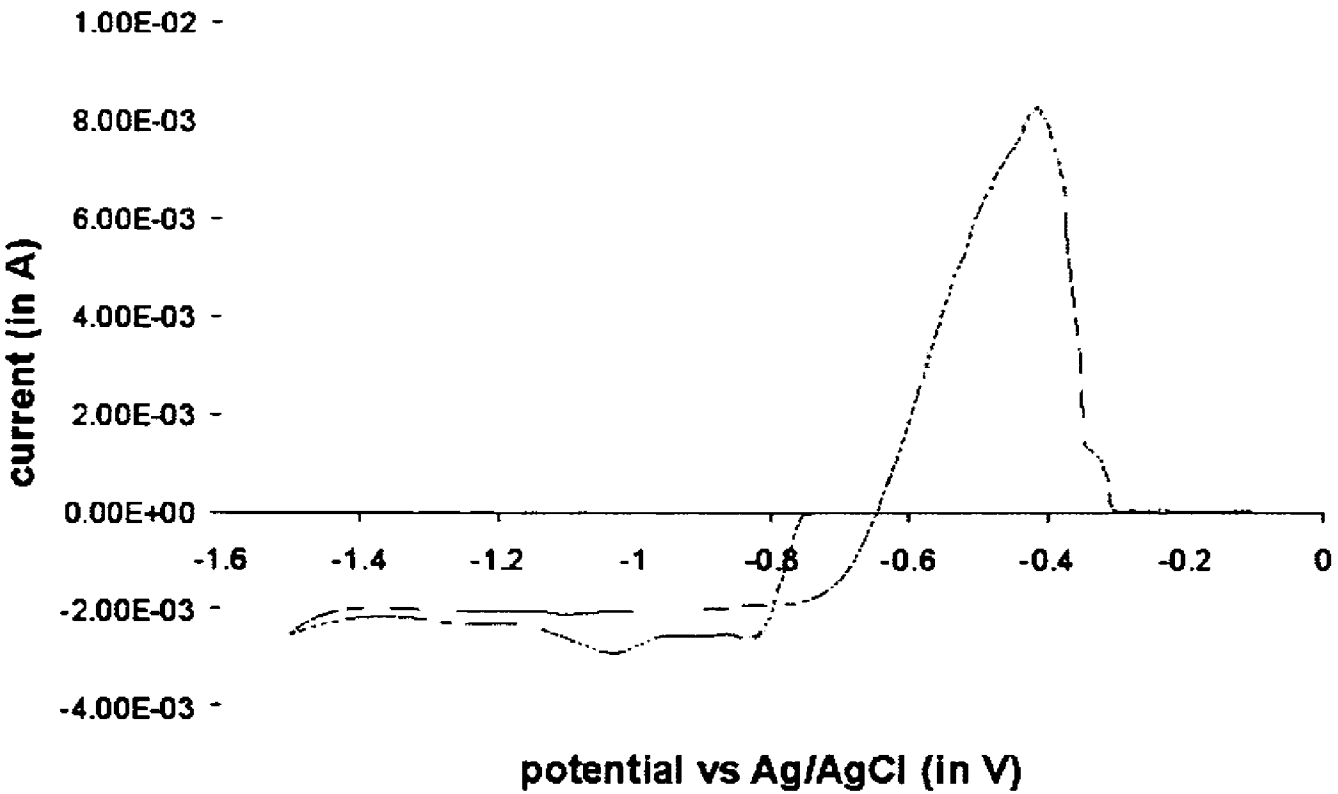
FIG. 3 represents the Cyclic voltammogram (scan rate 0.01V/s) obtained on the pattern in an electrolytic bath comprising $InCl_3$ to grow In nanowires within the pattern. It clearly shows an onset potential for indium deposition around −0.7V. The diffusion controlled region can be clearly identified in the range from −0.8V up to −1.4V (above which hydrogen evolution starts).

FIG. 3 shows a cyclic voltammogram obtained on this pattern at a scan rate of 0.01 V/s. The onset potential for indium deposition is around −0.7V (vs Ag/AgCl). The characteristics diffusion peak allows to identify the diffusion controlled region from −0.8V to −1.4V (above which hydrogen evolution starts). On the reverse scan, a stripping peak is observed.

Figure 4B:
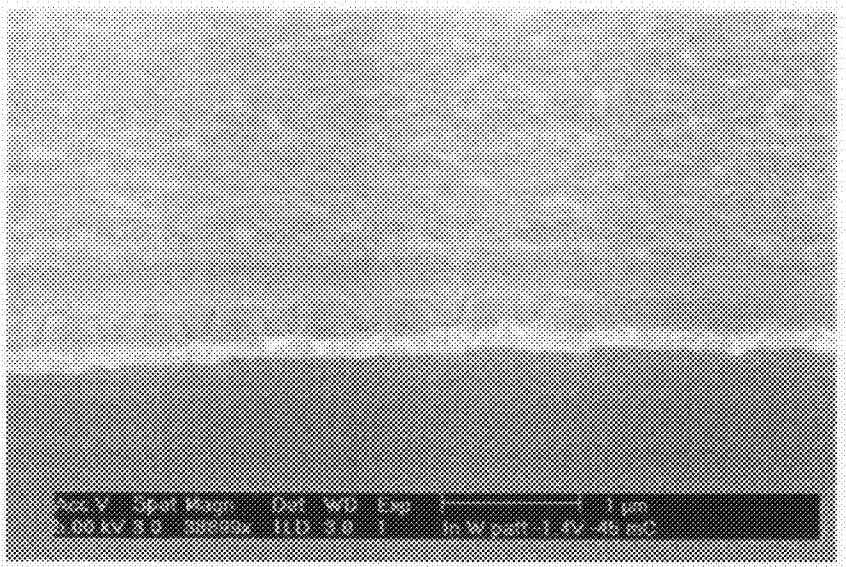
FIGS. 4A and 4B show the different morphologies observed for two potential settings (−1.2V and −1.4V versus Ag/AgCl reference electrode) for indium nanowire growth. The SEM picture obtained at potential values of −1.2V show a well uniform array of indium nanowires (FIG. 4A), lower potentials show also nanowire growth but with non-uniformity in the plating of the holes and adhesion problems. On the other hand, higher potentials show the formation of a polycrystalline film and lateral overgrowth out of the pattern.
Figure 4A:
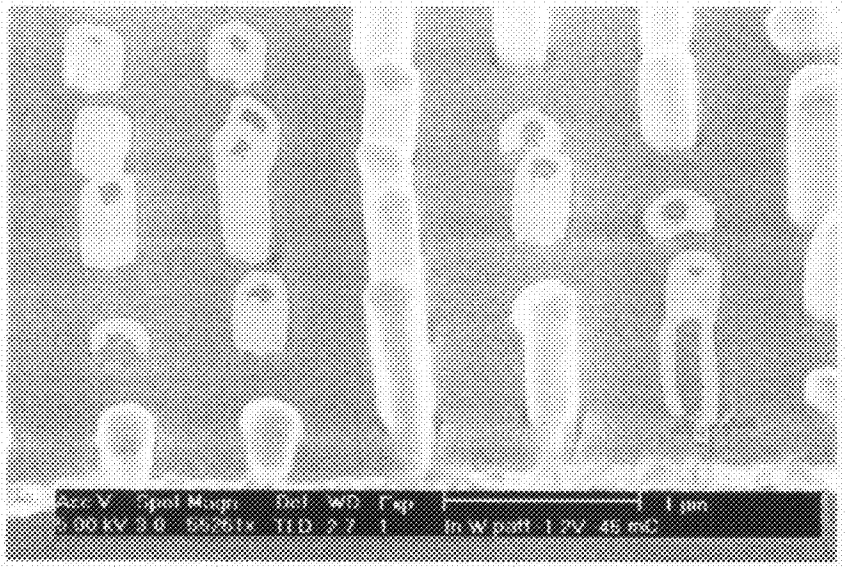

Plating has been performed at different potentials (from −0.8V to −1.4V vs Ag/AgCl) all in the diffusion controlled region. For the sake of comparison the same amount of charge was deposited (660 $mC/cm^2$) in each case. Scanning electron microscopy (SEM) has been performed after plating for these three samples. FIG. 4 shows the different morphologies observed for two of these potentials (−1.2V and −1.4V vs Ag/AgCl). For −1.2V vs Ag/AgCl (FIG. 4A) a uniform array of indium nanowire is observed. At less negative potentials nanowire growth is non-uniform with poor adhesion. More negative potentials (FIG. 4B) resulted in the formation of a polycrystalline film.

Figure 2B:
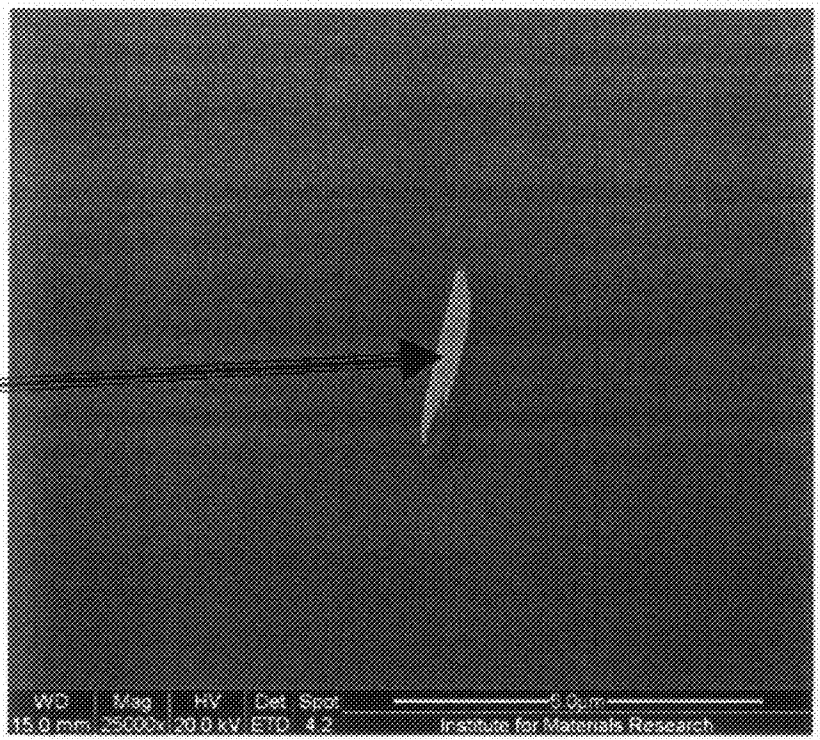
FIGS. 2A and 2B illustrate a SEM image and a Kikuchi pattern given by EBSD (Electron Backscatter Diffraction) of a 250 nm diameter indium nanowire. The diffraction pattern obtained is the same along the nanowire length showing its single-crystal nature.
Figure 2A:
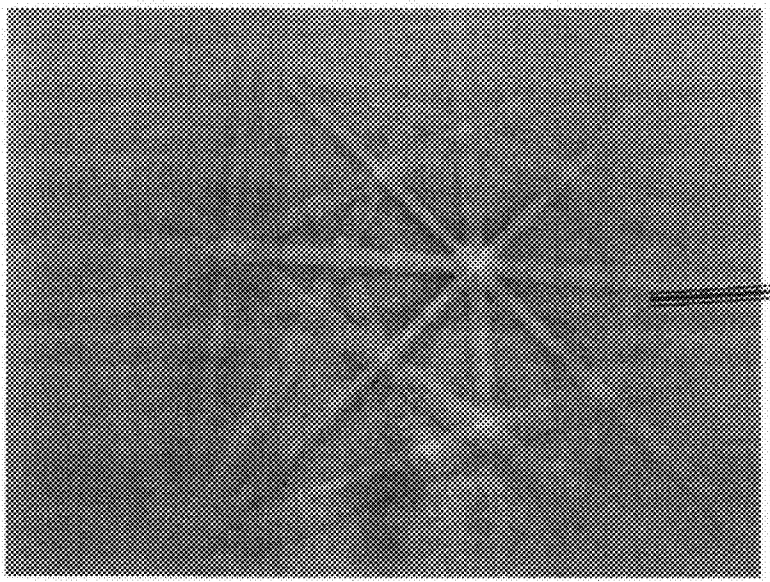

FIG. 2A shows a typical Kikuchi diffraction pattern for EBSD measurements on a 150 nm diameter indium nanowire (seen in FIG. 2B). This pattern fits with the tetragonal phase of indium. This same Kikuchi pattern is seen along the whole length of the nanowire. The persistence of the same Kikuchi diffraction pattern along this nanowire shows its monocrystalline nature.

Figure 6:
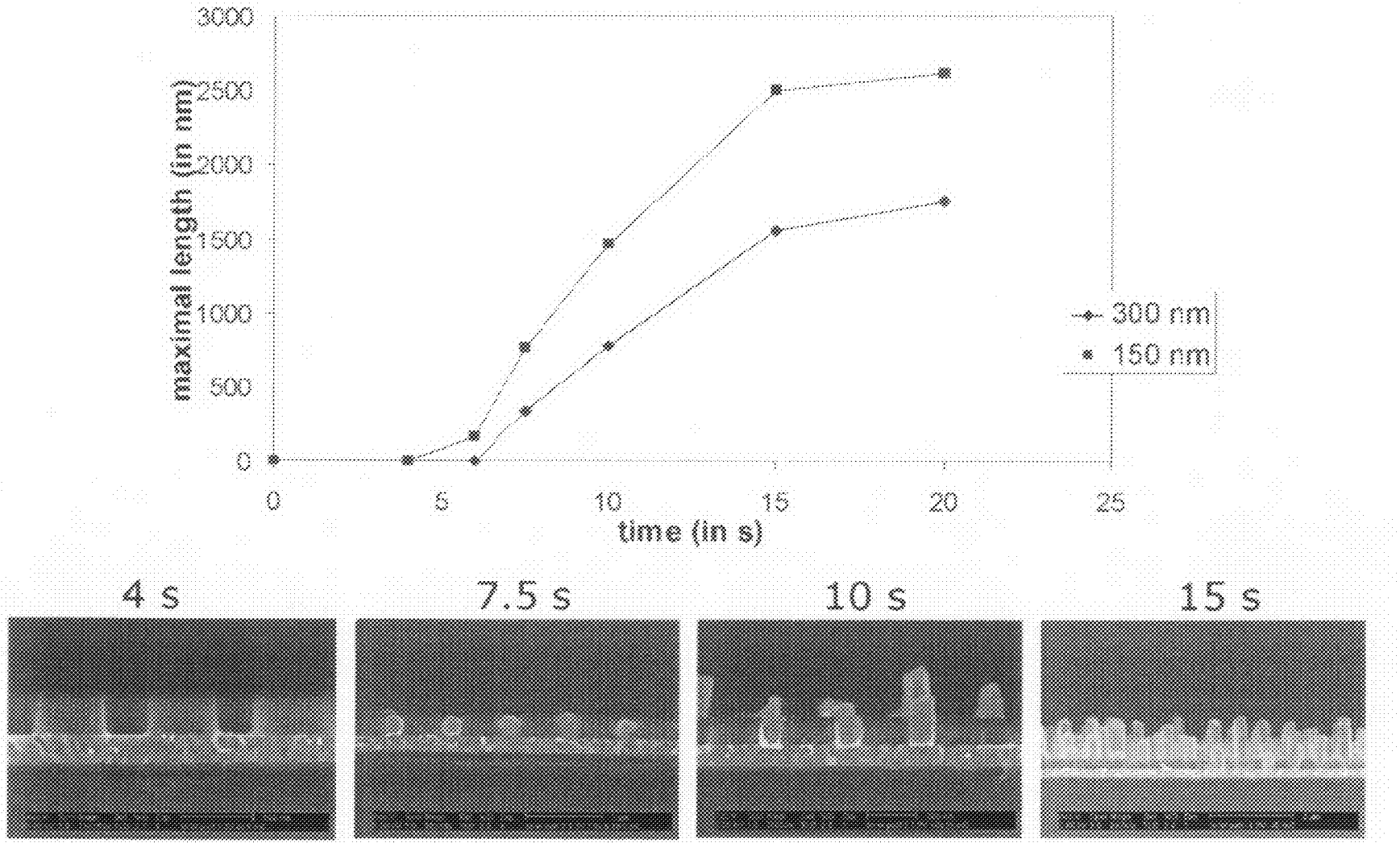
FIG. 6 represents the growth kinetics of the indium nanowire during plating at −1.2V versus Ag/AgCl and for 300 nm and 150 nm diameter dense contact holes. A graph of the maximal nanowire length in function of plating time with correlated SEM pictures for different times (4 s, 7.5 s, 10 s and 15 s). An induction time is observed and before 5 seconds no indium is deposited. The pictures show also that the difference in nanowire growth rate starts when the first nanowires pop out of the pattern.

Although all the nanowires of same diameter have similar growth rate at the beginning, variability in the rates as can be seen in FIG. 6 is observed as soon as the first nanowires come out of the pattern. FIG. 6 represents the growth kinetics of the indium nanowire during plating at −1.2V versus Ag/AgCl and for 300 nm and 150 nm diameter dense contact holes. A graph of the maximal nanowire length in function of plating time with correlated SEM pictures for different times (4 s, 7.5 s, 10 s and 15 s). An induction time is observed and before 5 seconds no indium is deposited. The pictures show also that the difference in nanowire growth rate starts when the first nanowires pop out of the pattern. FIG. 11 shows that a particular nanowire experiences an increase in growth rate as soon as it pops out of the pattern. This increase can be related to the change in diffusion field for the nanowire when it comes out of the hole (change for a 1D diffusional flux towards a 3D diffusional flux which carries much higher current).

Table 1 is showing the preferred parameters as well as the minimum and maximum value during electro-chemical deposition of indium nanowire growth.

TABLE 1

| Parameter | Most preferred | Range |
|---|---|---|
| HCl | 0.005M | pH dependent |
| InCl3 | 0.05M | 0.001M up to 0.25M |
| KCl | 0.2M | 0M up to 6M |
| pH | 2.5 ± 0.2 | 1 up to 3.5 |
| Potential | −1.2 V | −1.3 V up to −0.8 V |
| Time | 10 s | 5 s up to 20 s |
| Pitch | 2 | 2-4 |

Example 2

Electrolytic Bath Composition to Form Mono Crystalline In—NW

Table 2 is showing the electrolytic bath composition used to deposit mono-crystalline In—NW.

TABLE 2

| Parameter | Value |
|---|---|
| HCl | 0.005M |
| $InCl_3$ | 0.05M |
| KCl | 0.2M |
| pH | 2.5 ± 0.2 |
| Potential | −1 V up to −1.2 V |
| Time | 10 s |
| Pitch | 2 |

Alternatively and preferred the KCl concentration is in the range of 0.2M up to 3M.

Example 3

Electrolytic Bath Composition to Form Mono Crystalline In—NW

Table 3 is showing the electrolytic bath composition used to deposit mono-crystalline In—NW.

TABLE 3

| Parameter | Value |
|---|---|
| Citric acid | 0.2M |
| $InCl_3$ | 0.05M |
| Sodium citrate ($Na_3$-citrate) | 0.025M |
| pH | 2.5 ± 0.2 |
| Potential | −1 V up to −1.2 V |
| Time | 10 s |
| Pitch | 2 |

Example 4

Electrolytic Bath Composition to Form Mono Crystalline In—NW

Table 4 is showing the electrolytic bath composition used to deposit mono-crystalline In—NW.

TABLE 4

| Parameter | Value |
|---|---|
| L-tartaric acid | 0.2M |
| $InCl_3$ | 0.05M |
| HCl | 0.005M |

TABLE 4-continued

| Parameter | Value |
|---|---|
| pH | 2.5 ± 0.2 |
| Potential | −1 V up to −1.2 V |
| Time | 10 s |
| Pitch | 2 |

Example 5

Electrolytic Bath Composition to Form Mono Crystalline In—NW

Table 5 is showing the electrolytic bath composition used to deposit mono-crystalline In—NW.

TABLE 5

| Parameter | Value |
|---|---|
| Citric acid | 0.2M |
| $In_3(SO_4)_3$ | 0.025M |
| sodium citrate | 0.0025M |
| pH | 1.8 ± 0.2 |
| Potential | −1 V up to −1.2 V |
| Time | 10 s |
| Pitch | 2 |

All references cited herein are incorporated herein by reference in their entirety. To the extent publications and patents or patent applications incorporated by reference contradict the disclosure contained in the specification, the specification is intended to supersede and/or take precedence over any such contradictory material.

All numbers expressing quantities of ingredients, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A method for growing free-standing mono crystalline nanowires comprising at least one metal using electro-chemical deposition in an electrolytic bath, said method comprising the steps of:

depositing at least one dielectric layer onto a substrate;

creating a dense pattern of holes in said at least one dielectric layer by lithographic patterning and etching;

transferring said substrate comprising the dense pattern into an electrolytic plating bath comprising at least one metal salt; and forming free-standing mono crystalline nanowires that grow vertically out of the dense pattern by performing an electro-chemical deposition, wherein the dense pattern comprises holes with a dense array, said dense array having a pitch of from about 1 to about 5, such that a flux of ions from the electrolytic plating bath is minimized at the sidewalls of the free-standing mono crystalline nanowires and maximized at the top of the free-standing mono crystalline nanowires so as to promote one dimensional vertical growth of the free-standing mono crystalline nanowires and to substantially prevent lateral growth of the free-standing mono crystalline nanowires, wherein a length of the free-standing mono crystalline nanowires is longer than the depth of the holes in the dense pattern.

2. The method of claim 1, wherein said free-standing mono crystalline nanowires are selected from the group of metallic nanowires, semi-conductive nanowires, semi-metallic nanowires, and combinations thereof.

3. The method of claim 1, wherein said dielectric layer has a thickness of from about 50 nm to about 1 μm, and wherein the dielectric layer comprises a material selected from the group consisting of $SiO_2$, a low-k dielectric materials, a SiCO (H) material, a polyimide, a fluorinated polyimide, a benzocyclobutene, a fluorosilicate glass, a zeolite, a polymer, a resist layer, alumina, and combinations thereof.

4. The method of claim 1, wherein, before the step of depositing the dielectric layer, an extra layer is deposited, said extra layer acting as barrier layer, and said extra layer comprising a material selected from the group consisting of SiC, SiON, SiN, TaN, TiN, Ta, TaSiN, TiSiN, TiW, WN, and combinations thereof.

5. The method of claim 4, wherein, before the step of depositing the dielectric layer and before the step of depositing the extra layer, a conductive layer is deposited onto the substrate.

6. The method of claim 1, wherein said electrolytic bath composition comprises:

a metal salt, wherein the nanowires are derived from the metal of the metal salt;

a pH adjuster comprising an acid or a base; and an inert salt to adjust an electrolyte concentration of the electrolytic bath.

7. The method of claim 6, wherein the metal is a semi-metal.

8. The method of claim 6, wherein the acid is an inorganic acid selected from the group consisting of HCl and $H_2SO_4$.

9. The method of claim 6, wherein the acid is an organic acid selected from the group consisting of citric acid and tartaric acid.

10. The method of claim 6, wherein the inert salt comprises a cation selected from the group of K, Li, Na, and $NH_4$ and wherein the anion comprises a halogen.

11. A method for growing free-standing mono crystalline nanowires comprising at least one metal using electro-chemical deposition in an electrolytic bath, said method comprising the steps of:

depositing at least one dielectric layer onto a substrate;

creating a dense pattern of holes in said at least one dielectric layer by lithographic patterning and etching;

transferring said substrate comprising the dense pattern into an electrolytic plating bath comprising at least one metal salt, wherein the electrolytic plating bath has a pH value of from about 1 to about 3.5; and forming free-standing mono crystalline nanowires that grow vertically out of the dense pattern by performing an electro-chemical deposition, wherein the dense pattern comprises holes with a dense array, said dense array having a pitch of from about 1 to about 5, such that a flux of ions from the electrolytic plating bath is minimized at the sidewalls of the free-standing mono crystalline nanowires and maximized at the top of the free-standing mono crystalline nanowires so as to promote one dimensional vertical growth of the free-standing mono crystalline nanowires and to substantially prevent lateral growth of the free-standing mono crystalline nanowires, wherein a length of the free-standing mono crystalline nanowires is longer than the depth of the holes in the dense pattern.

12. The method of claim 1, wherein the electrolytic plating bath has a pH value of about 2.5±0.2.

13. The method of claim 1, wherein the metal is selected from the group consisting of In, Sb, Bi, Pb, Sn, and combinations thereof.

14. The method of claim 1, wherein the metal is indium and wherein the indium is in a form of a metal salt selected from the group consisting of $InCl_3$ and $In_2(SO_4)_3$.

15. The method of claim 1, wherein a concentration of said metal salt in the electrolytic plating bath is from about 0.001 M to about 0.25 M.

16. The method of claim 1, wherein the electrolytic plating bath comprises $InCl_3$ at a concentration of from about 0.001 M to about 0.25 M, KCl at a concentration of from about 0.1 M to about 3 M, and HCl at a concentration of from about 0.004 M to about 0.006 M, and wherein a pH value of the electrolyte plating bath is about 2.5±0.2.

17. The method of claim 1, wherein the electrolytic plating bath comprises $InCl_3$ at a concentration of from about 0.001 M to about 0.25 M, citric acid at a concentration of about 0.1 M to about 0.5 M, and sodium citrate at a concentration of from about 0.02 M to about 0.03 M, and wherein a pH value of the electrolyte plating bath is about 2.5±0.2.

18. The method of claim 1, wherein the electrolytic plating bath comprises $InCl_3$ at a concentration of from about 0.02 M to about 0.1 M, tartaric acid at a concentration of from about 0.1 M to about 0.5 M, and HCl at a concentration of from about 0.002 M to about 0.010 M, and wherein a pH value of the electrolyte plating bath is about 2.5±0.2.

19. The method of claim 1, wherein the electrolytic plating bath comprises $In_2(SO_4)_3$ at a concentration of from about 0.02 M to about 0.1 M, citric acid at a concentration of from about 0.1 M to about 0.5 M, and sodium citrate at a concentration of from about 0.02 M to about 0.03 M, and wherein a pH value of the electrolyte plating bath is about 1.8±0.2.

20. The method of claim 1, wherein said pattern comprises holes with in-plane dimensions of from about 100 nm to about 1 μm deep and a diameter opening of from about 5 nm to about 500 nm.

21. The method of claim 1, wherein the free-standing mono crystalline nanowires are single-metal nanowires, wherein the metal is selected from the group of In, Sb, Bi, Pb, and Sn.

22. The method of claim 1, wherein the free-standing mono crystalline nanowires are combination-metal nanowires, wherein the metals of the combination are selected from the group of In, Sb, Bi, Pb, Sn, As, P, and Te.

23. The method of claim 1, wherein the free-standing mono crystalline nanowires have a diameter of from about 5 nm to about 500 nm and a length of from about 100 nm to about 10 μm.

24. The method of claim 1, wherein said dense pattern comprises "thiefs" structures surrounding a nanowire hole.

25. The method of claim 24, wherein said "thiefs" structures surrounding the nanowire hole are sacrificial, such that said "thiefs" structures have no functional purpose other than thieving a current.

26. The method of claim 24, wherein said "thiefs" structures surrounding the nanowire hole comprise structures selected from the group consisting of a ring structure surrounding the nanowire hole, a segmented ring structure surrounding the nanowire hole, two rectangular structures, a continuous square, a segmented square, a hole, a continuous diamond, a segmented diamond, a continuous line, a segmented line, and combinations thereof.

27. The method of claim 24, wherein said "thiefs" structures surrounding the nanowire hole are permanent, such that said structures have functional purposes other than thieving a current.

28. The method of claim 1, wherein said substrate is a silicon wafer.

29. The method of claim 1, wherein said electrochemical deposition is performed at a constant potential.

30. The method of claim 29, wherein said electrochemical deposition is performed at a constant potential of from about −1.5 V versus the standard hydrogen electrode to about −1 V versus the standard hydrogen electrode.

31. A method for growing free-standing mono crystalline nanowires comprising at least one metal using electro-chemical deposition in an electrolytic bath, said method comprising the steps of:

depositing at least one dielectric layer onto a substrate;

creating a dense pattern of holes in said at least one dielectric layer by lithographic patterning and etching;

transferring said substrate comprising the dense pattern into an electrolytic plating bath comprising at least one metal salt;

forming free-standing mono crystalline nanowires that grow vertically out of the dense pattern by performing an electro-chemical deposition, wherein the dense pattern comprises holes with a dense array, said dense array having a pitch of from about 1 to about 5, such that a flux of ions from the electrolytic plating bath is minimized at the sidewalls of the free-standing mono crystalline nanowires and maximized at the top of the free-standing mono crystalline nanowires so as to promote one dimensional vertical growth of the free-standing mono crystalline nanowires and to substantially prevent lateral growth of the free-standing mono crystalline nanowires, wherein said electrochemical deposition is performed at a constant potential of −1.4 V versus the standard hydrogen electrode for the growth of free-standing monocrystalline In nanowires, wherein a length of the free-standing mono crystalline nanowires is longer than the depth of the holes in the dense pattern.

32. The method of claim 1, wherein said electrochemical deposition is performed at a constant current.

33. The method of claim 1, wherein the metal salt is a chloride salt.

34. The method of claim 31, wherein the electrolytic plating bath has a pH value of from about 1 to about 3.5.

* * * * *